US010854368B2

(12) United States Patent
Brodeur et al.

(10) Patent No.: US 10,854,368 B2
(45) Date of Patent: Dec. 1, 2020

(54) ELECTRICAL EQUIPMENT WITH RUPTURE OIL DEFLECTOR

(71) Applicant: ABB Power Grids Switzerland AG, Baden (CH)

(72) Inventors: Samuel Brodeur, Varennes (CA); Patrice Lamothe, Varennes (CA); Alexandre Cote, Varennes (CA); Claude Lambert, Varennes (CA)

(73) Assignee: ABB Power Grids Switzerland AG, Baden (CH)

( * ) Notice: Subject to any disclaimer, the term of this patent is extended or adjusted under 35 U.S.C. 154(b) by 182 days.

(21) Appl. No.: 15/987,315

(22) Filed: May 23, 2018

(65) Prior Publication Data

US 2019/0362876 A1 Nov. 28, 2019

(51) Int. Cl.
*H01F 27/02* (2006.01)
*H01F 27/12* (2006.01)

(52) U.S. Cl.
CPC ..... *H01F 27/02* (2013.01); *H01F 27/12* (2013.01)

(58) Field of Classification Search
CPC ..... H01F 27/02; H01F 27/12; H01F 27/025; H01F 27/08; H01F 27/10; H01F 27/105; H01F 27/125; H01F 27/14; H01F 27/16; H01F 27/2876; H01F 27/002; H01F 2027/404; H01F 2027/402
USPC ..... 336/90, 57, 58, 94
See application file for complete search history.

(56) References Cited

U.S. PATENT DOCUMENTS 3,474,369 A * 10/1969 Keogh ..... H01F 27/002 336/65
3,914,528 A 10/1975 Johnson
4,005,341 A * 1/1977 Uptegraff, Jr. ..... H01F 27/02 361/38
4,085,395 A * 4/1978 Billerbeck ..... H01F 27/025 336/61
4,106,068 A * 8/1978 Flanagan ..... H01G 2/14 361/15
4,173,776 A * 11/1979 Mercier ..... H01G 4/224 361/272
4,359,386 A * 11/1982 Crema ..... B01D 17/10 210/336
4,453,197 A 6/1984 Burrage
4,511,873 A * 4/1985 Baier ..... H01F 38/30 174/17 GF
5,391,835 A 2/1995 Yao et al.
(Continued)

FOREIGN PATENT DOCUMENTS

JP 62229911 A * 10/1987
WO 2016059128 A1 4/2016
WO 2016147158 A1 9/2016

OTHER PUBLICATIONS

R.E. Kothmann et al.; Power Transformer Tank Rupture: Risk Assessment and Mitigation; Apr. 1995; 165 pgs.; Palo Alto, California (Previously submitted on May 23, 2018).

(Continued)

*Primary Examiner* — Mang Tin Bik Lian
(74) *Attorney, Agent, or Firm* — Sage Patent Group

(57) ABSTRACT

An electrical equipment is provided that prevents uncontrolled explosions that may occur due to arc faults in the tank. During an overpressure condition caused by an arc fault, the top of the tank ruptures along a weakened region. Cooling oil that escapes during a rupture is redirected by a deflector to prevent the oil from spraying outward from the tank.

24 Claims, 2 Drawing Sheets

(56) References Cited

U.S. PATENT DOCUMENTS

| | | | | |
|---|---|---|---|---|
| 7,317,598 | B2 | 1/2008 | Magneir | |
| 8,264,804 | B2 | 9/2012 | Magnier | |
| 8,299,880 | B2 | 10/2012 | Scian et al. | |
| 8,319,590 | B2 | 11/2012 | Magnier | |
| 8,717,134 | B2 * | 5/2014 | Pintgen | H01F 27/14 174/17 LF |
| 9,815,594 | B2 | 11/2017 | Brodeur | |
| 9,935,454 | B2 | 4/2018 | Tepper et al. | |
| 2010/0065306 | A1 * | 3/2010 | Pintgen | H01F 27/02 174/17 VA |
| 2011/0254647 | A1 * | 10/2011 | Bacarisse | H01F 27/025 336/92 |
| 2013/0187739 | A1 | 7/2013 | Sullivan et al. | |
| 2013/0240220 | A1 | 9/2013 | Loureiro et al. | |
| 2014/0166329 | A1 * | 6/2014 | Ballard | H01F 27/02 174/50 |
| 2015/0188297 | A1 * | 7/2015 | Boe | H01F 27/14 174/564 |
| 2019/0037727 | A1 * | 1/2019 | Patel | H02B 1/56 |

OTHER PUBLICATIONS

Arne Peterson et al.; Guide for Transformer Fire Safety Practices; Technical Brochure 537; Cigre; Jun. 2013; 139 pgs.; Paris, France (Previously submitted on May 23, 2018).

M. Foata et al.; Power Transformer Tank Rupture Prevention; Cigre; 2010; 10 pgs.; Paris, France (Previously submitted on May 23, 2018).

Bob Middleton et al.; Explosion Resistant Transformers How Utilities Should Evaluate and Use This Technology; 2012; 23 pgs. (Previously submitted on May 23, 2018).

M. Foata; Power Transformer Tank Rupture; Canadian Electrical Association; 2010; 27 pgs.; Varennes, Quebec (Previously submitted on May 23, 2018).

M. Foata; Power Transformer Fire Risk Assessment; Cigre; 2008; 8 pgs.; Sydney, Australia (Previously submitted on May 23, 2018).

Abi-Samra et al.; Power Transformer Tank Rupture and Mitigation-A Summary of Current State of Practice and Knowledge by the Task Force of IEEE Power Transformer Subcommittee; IEEE Transaction on Power Delivery; vol. 24, No. 4; Oct. 2009; 9 pgs.; Piscataway, New Jersey (Previously submitted on May 23, 2018).

S. Brodeur et al.; A Flexible Friend; ABB Review Jan. 2016; 2016; 6 pgs. (previously submitted on May 23, 2018).

A. Cote et al.; BC Hydro Mica T5 & T6; Transformer Oil Spray Protective Blanket; May 29, 2016; 15 pgs. (Previously submitted on May 23, 2018).

The International Search Report and the Written Opinion issued in corresponding International application No. PCT/IB2019/054245, dated Nov. 28, 2019, 12 pp.

* cited by examiner

ELECTRICAL EQUIPMENT WITH RUPTURE OIL DEFLECTOR

BACKGROUND

The present inventions relate generally to electrical equipment, and more particularly, to a deflector to redirect escaping oil.

Large industrial electrical equipment, such as transformers and shunt reactors, typically have a tank that encloses high-voltage components and cooling oil to cool the high-voltage components. In order to prevent people from inadvertently been exposed to the high-voltage components and cooling oil, the tank is sealed to prevent unintended access inside of the tank.

One risk associated with industrial electrical equipment are electrical faults that may occur within the equipment. When a fault occurs, an electrical arc may form between high-voltage components with different voltage potentials, between a high-voltage component and the tank wall (which is grounded), or elsewhere within the tank. As the arc forms, cooling oil around the arc vaporizes and increases the pressure within the equipment tank. If the pressure within the tank rises to a high enough level, the tank can explode by bursting the walls of the tank.

One consequence of a tank explosion is that the cooling oil in the tank can escape. This can be problematic for many reasons. For example, the oil itself is considered to be a hazardous material. In some cases, the entire sidewall of a tank has been known to split from top to bottom which results in all of the cooling oil in the tank spilling out and contaminating the ground. However, even when the amount of escaping oil is minimized, the cooling oil may spray out of the tank and travel a significant distance before falling to the ground. In addition to the environmental concerns, spraying oil can be a safety hazard if nearby people are contacted by the spraying oil. For example, the high pressure or high temperature of an oil spray may harm a nearby person when an equipment tank explodes.

SUMMARY

An electrical equipment is described that is designed to rupture along the top of the tank to release pressure during an overpressure condition. When the tank ruptures, cooling oil inside of the tank can escape as a spray through the rupture opening. In order to prevent the spray from spreading out from the tank, a deflector is provided along the top of the tank to redirect escaping oil.

BRIEF DESCRIPTION OF SEVERAL VIEWS OF THE DRAWINGS

The invention may be more fully understood by reading the following description in conjunction with the drawings, in which.

DETAILED DESCRIPTION

Figure 1:
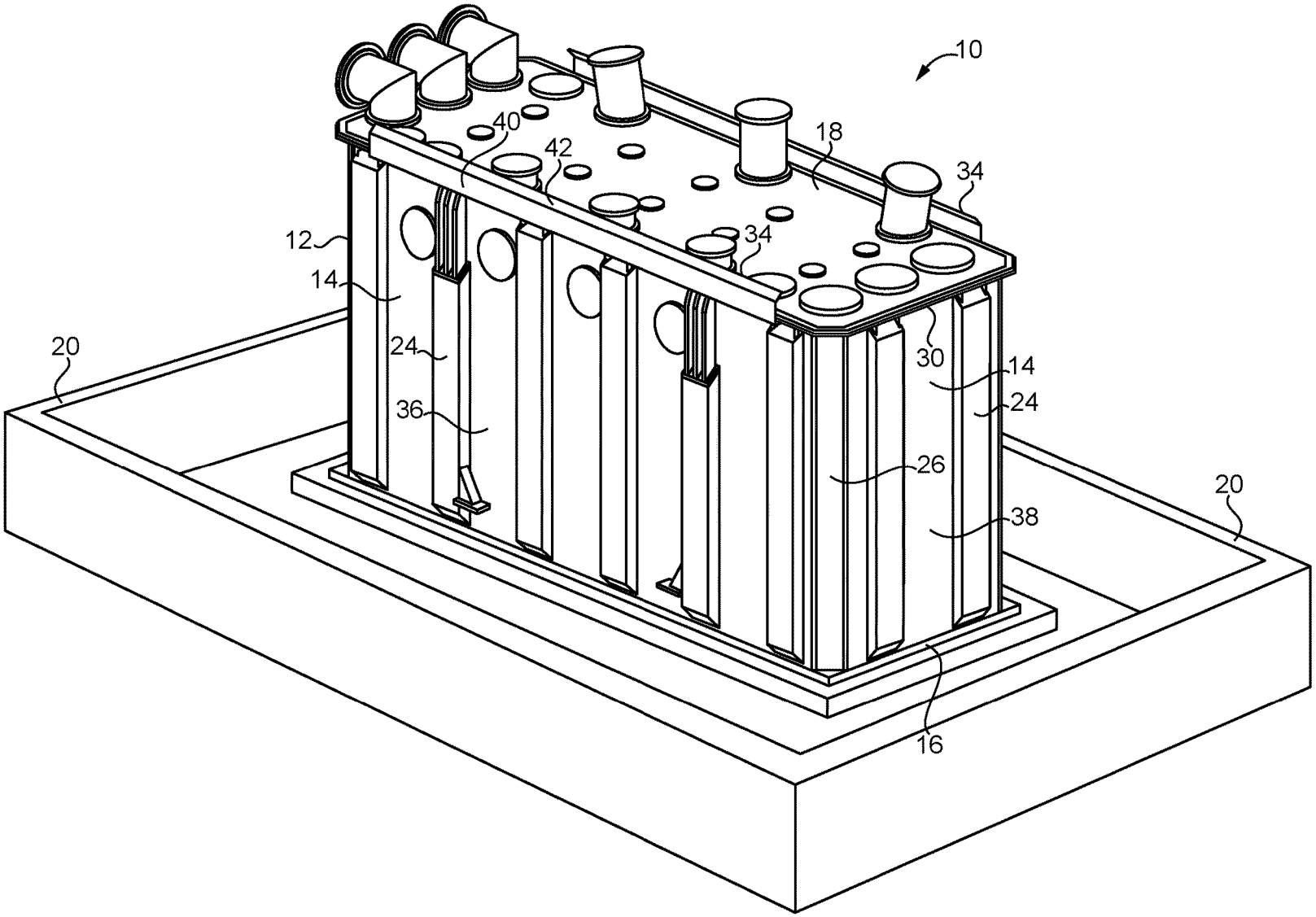
FIG. 1 is a perspective view of a transformer.

Referring now to the figures, and particularly FIG. 1, an electrical equipment 10 is shown, which in this embodiment is a transformer 10. The transformer 10 includes a tank 12 with sidewalls 14 that extend upward from a base 16. The top of the tank 12 is enclosed with a top cover 18. As is understood in the art, the transformer 10 includes high-voltage components and cooling oil in the tank 12. The high-voltage components are typically immersed in the cooling oil. The tank 12 prevents inadvertent access to the high-voltage components therein and contains the cooling oil. In case oil leaks from the tank 12 or otherwise escapes therefrom, a containment structure 20 may be provided around the base 16 of the transformer 10. The containment structure 20 may be, for example, a short wall 20 that surrounds the transformer 10. However, it is understood that other types of containment structures 20 may also be used, such as a drain that directs oil to an underground reservoir. Thus, the containment structure 20 traps oil that escapes to prevent oil from spilling out onto the surrounding ground. Preferably, the containment structure 20 is less than half the height of the sidewalls 14.

The transformer 10 may be designed to respond in stages to overpressure conditions that may result from electrical arcs within the transformer 10. For example, in a first stage, the sidewalls 14 of the tank 12 may be designed to plastically deform to absorb the overpressure condition without bursting the sidewalls 14. This may be done by adding reinforcement ribs 24 to the sidewalls 14 and widening the sidewall corners 26 to prevent the sidewalls 14 from bursting open.

Figure 3:
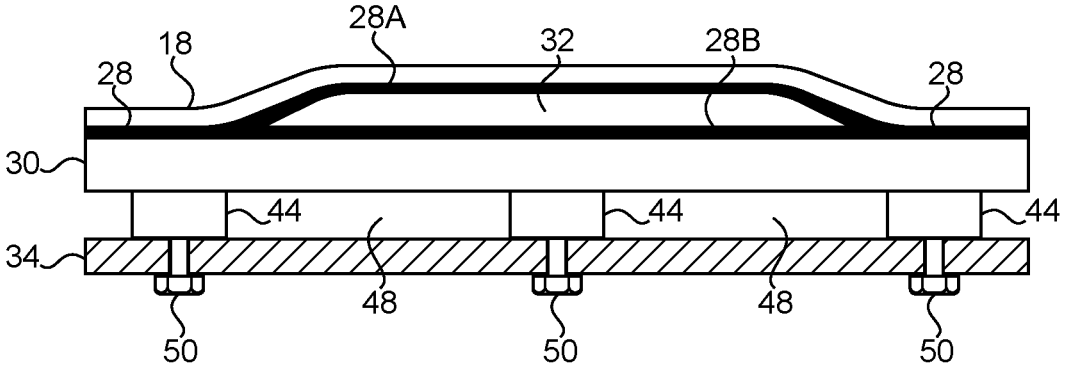
FIG. 3 is a side view of another portion of the transformer.

As shown in FIG. 3, a second stage may include a weakened region 28 that ruptures to allow pressure to escape from the tank 12. Preferably, the tank 12 plastically deforms first as noted above in case plastic deformation is sufficient to contain the overpressure condition without rupturing the tank 12. However, if the overpressure condition is high enough, the tank 12 may be designed to rupture in a controlled fashion to minimize any damage or harm that may be caused by the transformer 10 failure.

Figure 2:
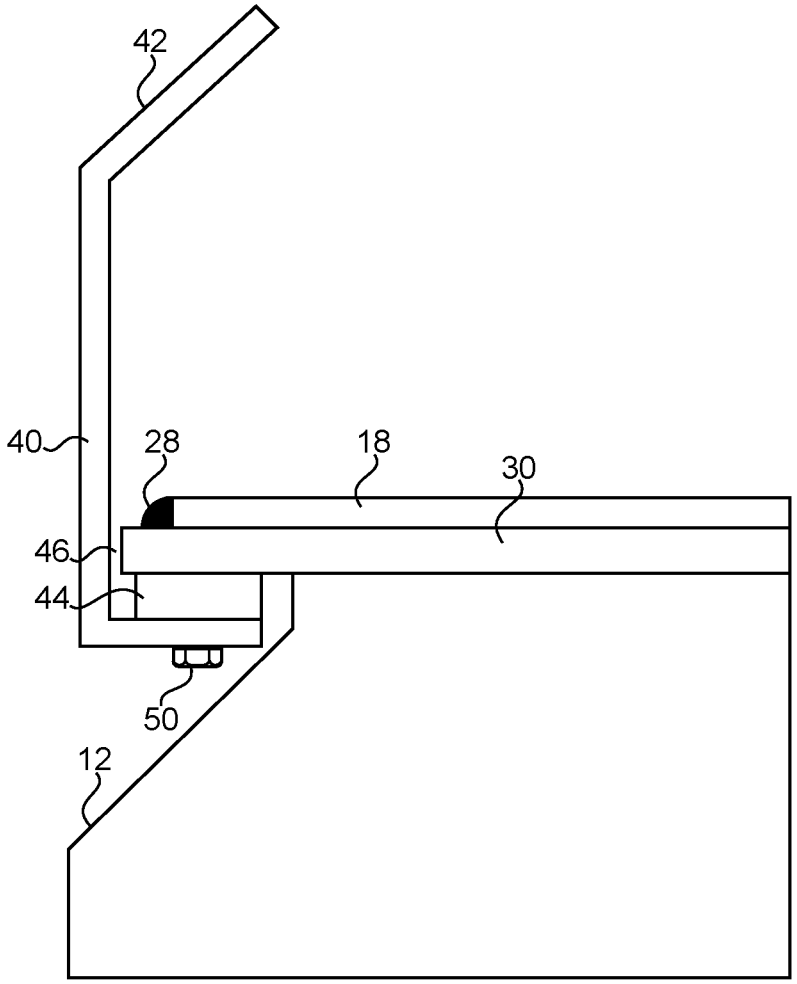
FIG. 2 is a side view of a portion of the transformer.

As shown in FIGS. 2 and 3, the top cover 18 is preferably welded 28 around its perimeter to a flange 30 at the top of the sidewalls 14. However, it may also be possible to attach the top cover 18 to the flange 30 with bolts. The weld 28 may be designed as a weakened region 28 that ruptures at a particular pressure level. Thus, as shown in FIG. 3, when the weakened region 28 ruptures, the weld 28 separates 28A, 28B and the top cover 18 separates from the flange 30 to form an opening 32 therebetween. As a result, pressure can be released from the tank 12 through the ruptured opening 32. Preferably, the weakened region 28 is along the top portion of the transformer 10 so that most of the cooling oil remains in the tank 12 after the rupture without spilling on the ground.

Although the rupture 32 is designed to occur at the top of the tank 12, there remains some concern that a certain amount of oil may spray out of the ruptured opening 32 during an overpressure condition. In order to minimize any environmental or safety hazards associated with spraying oil, a deflector 34 as shown in FIGS. 1 and 2 may be provided. The deflector 34 is preferably rigid and made of metal. As shown in FIG. 1, it may be preferable to provide deflectors 34 only along the long sides 36 of the transformer 10 and not on the short sides 38. The reason for this is that a rupture 32 of the weld 28 will only occur along the long sides 36 of the transformer 10 and will not occur along the short sides 38. Moreover, it may be useful to leave the top of the short sides 38 open and unobstructed by a deflector 34 to allow easier access for piping and other equipment. In order to completely cover the ruptured opening 32, the deflector 34 preferably extends along at least 50% of the length of the long sides 36, and more preferably, at least 75% of the length of the long sides 36.

As shown in FIG. 2, the deflector 34 may have a vertical portion 40 that is laterally spaced outward from the weld 28. Above the weld 28, the deflector 34 may also have an overhang portion 42 that extends inward toward the center of the tank 12 and covers the weld 28. Thus, when oil escapes from a ruptured opening 32 through the weld 28, spraying oil will contact the inner surface of the deflector 34 to redirect the escaping oil. As a result, outward spraying of oil is limited and prevented from spraying long distances away from the transformer 10.

The deflector 34 may be attached to the flange 30 at the top of the tank 12. For example, the deflector 34 may be attached to the bottom of the flange 30 as shown in FIG. 2. As shown in FIG. 3, spaced apart blocks 44 are preferably welded to the bottom side of the flange 30. The deflector 34 may then be attached to the bottom side of the blocks 44. This arrangement is preferred to provide a pathway for oil to flow down after contacting the deflector 34. For example, after the oil contacts the inside of the deflector 34, oil can flow down through the lateral space 46 between the deflector 34 and the flange 30. The oil can then continue to flow through the vertical space 48 between the flange 30 and the deflector 34 and the blocks 44. In order to see the vertical space 48 more clearly, the vertical and overhang portions 40, 42 of the deflector 34 have been cut away in FIG. 3. The oil then flows downward along the outside of the sidewalls 14 of the tank 12. As a result, oil flows down along the sidewalls 14 to the containment structure 20 without escaping uncontrolled away from the containment structure 20.

As shown in FIG. 3, it is also preferred for the deflector 34 to be attached to the tank 12 (e.g., the flange 30) with threaded fasteners 50. This allows the deflectors 34 to be installed at a jobsite where the transformer 10 will be used instead of having to be installed at the factory. Thus, the transformer 10 can be shipped without the deflectors 34 being installed. This may be desirable to decrease shipping space needed to transport the transformer 10 to the location of use.

While preferred embodiments of the inventions have been described, it should be understood that the inventions are not so limited, and modifications may be made without departing from the inventions herein. While each embodiment described herein may refer only to certain features and may not specifically refer to every feature described with respect to other embodiments, it should be recognized that the features described herein are interchangeable unless described otherwise, even where no reference is made to a specific feature. It should also be understood that the advantages described above are not necessarily the only advantages of the inventions, and it is not necessarily expected that all of the described advantages will be achieved with every embodiment of the inventions. The scope of the inventions is defined by the appended claims, and all devices and methods that come within the meaning of the claims, either literally or by equivalence, are intended to be embraced therein.

The invention claimed is:

1. An electrical equipment, comprising:

a tank with side walls comprising opposing short side walls and opposing long side walls, the tank containing a cooling oil;

a top cover attached to the tank and enclosing the cooling oil;

a weakened region between the tank and the top cover, wherein the weakened region ruptures when an overpressure condition occurs in the tank to release pressure; and a deflector extending along at least a portion of the top cover and disposed outward from the weakened region and having an overhang portion disposed over the weakened region and extending inward toward a center of the tank, the deflector being disposed along one of the opposing long side walls, at least some of the cooling oil escaping under pressure when the weakened region ruptures, the cooling oil escaping contacting an inner surface of the deflector and being redirected to limit outward spraying of the cooling oil escaping.

2. The electrical equipment according to claim 1, wherein the top cover is welded to the tank.

3. The electrical equipment according to claim 1, wherein the deflector is attached to the tank.

4. The electrical equipment according to claim 1, wherein the tank comprises a flange at a top thereof, the top cover being attached to the flange.

5. The electrical equipment according to claim 4, wherein the deflector is attached to the flange.

6. The electrical equipment according to claim 5, wherein the deflector is attached to the flange with threaded fasteners, the deflector thereby being configured to be unattached from the tank during shipping and to be attached to the tank at a site of usage.

7. The electrical equipment according to claim 1, further comprising a space below the weakened region and between the deflector and the tank, the space being configured for the cooling oil escaping to flow down through the space to sidewalls of the tank.

8. The electrical equipment according to claim 7, further comprising spaced apart blocks attached to the tank, the deflector being attached to the blocks, wherein the space is disposed between the spaced apart blocks and between the tank and the deflector.

9. The electrical equipment according to claim 8, wherein the tank comprises a flange at a top thereof, the blocks are attached to a bottom side of the flange, and the deflector is attached to a bottom side of the blocks.

10. The electrical equipment according to claim 1, further comprising a containment structure surrounding a base of the tank, the containment structure being configured to contain cooling oil that escapes from the tank, the deflector redirecting the cooling oil escaping to an inside of the containment structure.

11. The electrical equipment according to claim 1, wherein the deflector comprises a vertical portion laterally spaced from the weakened region.

12. The electrical equipment according to claim 1, wherein the the deflector is not disposed along the opposing short side walls.

13. The electrical equipment according to claim 1 wherein the deflector extends along at least 50% of a length of one of the long sidewalls.

14. The electrical equipment according to claim 13 wherein the deflector extends along at least 75% of a length of one of the long sidewalls.

15. The electrical equipment according to claim 1, wherein the side walls plastically deform to absorb overpressure before the weakened region ruptures.

16. The electrical equipment according to claim 1, further comprising a space below the weakened region and between the deflector and the tank the space being configured for the cooling oil escaping to flow down through the space to the sidewalls of the tank, and further comprising a containment structure surrounding a base of the tank, the containment structure being configured to contain cooling oil that escapes from the tank, the deflector redirecting the cooling oil escaping to an inside of the containment structure.

17. The electrical equipment according to claim 16, wherein the top cover is welded to the tank, the deflector is attached to the tank with threaded fasteners, the deflector thereby being configured to be unattached from the tank during shipping and to be attached to the tank at a site of usage, the deflector comprises a vertical portion laterally spaced from the weakened region, and the deflector comprises an overhang portion disposed over the weakened region and extending inward toward a center of the tank.

18. The electrical equipment according to claim 17, wherein the tank comprises a flange at a top thereof, the top cover being welded to the flange, the deflector is attached to the flange, the side walls comprise opposing short side walls and opposing long side walls, one of the deflector being disposed along each of the opposing long side walls and not along the opposing short side walls, and the deflector extends along at least 75% of a length of one of the sidewalls.

19. The electrical equipment according to claim 18, further comprising spaced apart blocks attached to a bottom side of the flange, the deflector is attached to a bottom side of the blocks, the space is disposed between the blocks and between the tank and the deflector, and the side walls plastically deform to absorb overpressure before the weakened region ruptures.

20. The electrical equipment according to claim 15, wherein the side walls comprise reinforcement ribs to prevent the sidewalls from bursting in a first overpressure stage, the side walls plastically deforming in the first overpressure stage before a second overpressure stage when the weakened region ruptures.

21. The electrical equipment according to claim 1, wherein the electrical equipment is a transformer.

22. The electrical equipment according to claim 21, wherein the tank responds in stages to overpressure conditions resulting from electrical arcs within the tank, the tank plastically deforming to absorb the overpressure condition without bursting the sidewalls in a first stage, and the weakened region rupturing to allow pressure to escape from the tank in a second stage.

23. The electrical equipment according to claim 22, wherein the deflector minimizes environmental or safety hazards associated with spraying of the cooling oil when the weakened region ruptures.

24. The electrical equipment according to claim 1, wherein the deflector minimizes environmental or safety hazards associated with spraying of the cooling oil when the weakened region ruptures.

* * * * *